US006360382B1

(12) United States Patent
Karash

(10) Patent No.: US 6,360,382 B1
(45) Date of Patent: Mar. 26, 2002

(54) POWERED TOILET SEAT LIFT

(75) Inventor: L. Stanley Karash, Hastings, NE (US)

(73) Assignee: Karding, Inc., Hastings, NE (US)

( * ) Notice: Subject to any disclaimer, the term of this patent is extended or adjusted under 35 U.S.C. 154(b) by 0 days.

(21) Appl. No.: 09/286,685

(22) Filed: Apr. 5, 1999

(51) Int. Cl.[7] ..... A47K 13/10
(52) U.S. Cl. ..... 4/667
(58) Field of Search ..... 4/254, 667

(56) References Cited

U.S. PATENT DOCUMENTS

| | | | | |
|---|---|---|---|---|
| 3,060,458 A | | 10/1962 | Burke | 4/667 X |
| 3,473,174 A | | 10/1969 | Cool | 4/667 |
| 4,031,576 A | | 6/1977 | Epstein | 4/667 |
| 4,168,552 A | | 9/1979 | Austin | 4/667 |
| 4,185,335 A | | 1/1980 | Alvis | 4/667 |
| 4,581,778 A | | 4/1986 | Pontoppidan | 4/667 |
| 4,833,736 A | | 5/1989 | Sadler et al. | 4/667 |
| 4,993,085 A | | 2/1991 | Gibbons | 4/667 |
| 5,027,446 A | | 7/1991 | Robertson et al. | 4/667 X |
| 5,063,617 A | | 11/1991 | Ward et al. | 4/667 |
| 5,142,709 A | | 9/1992 | McGuire | 4/667 |
| 5,155,873 A | * | 10/1992 | Bridges | 4/667 |
| 5,561,872 A | * | 10/1996 | Phillips | 4/667 |
| 5,592,703 A | | 1/1997 | Jones et al. | 4/667 |
| 5,661,858 A | * | 9/1997 | House et al. | 4/667 |
| 6,098,215 A | * | 8/2000 | Goodwin | 4/667 |

* cited by examiner

*Primary Examiner*—Robert M. Fetsuga
(74) *Attorney, Agent, or Firm*—Vincent L. Carney

(57) ABSTRACT

An apparatus is disclosed for moving a toilet seat between a lowered position adjacent a toilet bowl and a raised, tilted position above the toilet bowl to assist a physically disabled person between an upright position and a seating position for using a toilet. The apparatus includes a toilet seat having a passageway therethrough, a support structure positioned about a base portion of a toilet bowl, a linkage mechanism attached to the support structure for raising the toilet seat directly above the toilet bowl and for tilting the toilet seat such that the rear portion of the toilet seat assumes a vertically higher position than a front portion of the toilet seat, and a power mechanism for urging the toilet seat between the lowered position and the raised, tilted position.

19 Claims, 4 Drawing Sheets

POWERED TOILET SEAT LIFT

BACKGROUND OF THE INVENTION

1. Field of the Invention

The present invention relates to devices for assisting physically disabled persons to and from a position for using a toilet.

2. Description of The Related Art

Conventional toilet seats are characteristically low to the ground making it very difficult for physically disabled or illness-weakened persons to use the toilet without the assistance of a nurse or other individual. Elevated toilet seats or toilet seat lifts that remain horizontal partially solve this problem by reducing the period of time that a person's arm and leg muscles are stressed when moving between a standing position and a sitting position on a toilet bowl. U.S. Pat. Nos. 4,168,552 and 5,027,446, for example, disclose toilet seat lifts that simply elevate the toilet seat. The '552 patent describes an adjustable toilet seat that is elevated by screw jacks driven by an electric motor through a drive belt and pulley system. The '446 patent discloses a mechanism for raising and lowering a toilet seat via two hydraulic cylinders. The toilet seat for these apparatus always remains horizontal to floor.

Elderly or physically disabled persons, however, may not be able to withstand even this reduced amount of stress encountered when attempting to sit on the raised, but still horizontal, toilet seat. Thus, toilet seats have been developed that both elevate and tilt the toilet seat such that the rear portion of the seat is vertically higher than the front portion. For example, U.S. Pat. No. 5,063,617 discloses an apparatus for raising and lowering a toilet seat. As this toilet seat lift rises, it assumes an orientation that is tilted thus facilitating the mounting and dismounting of the user. Other toilet seat lifts tilt the seat and move the seat forward of the toilet base for transferring the weight of the user such that it is approximately above their feet. For example, U.S. Pat. Nos. 4,581,778, 4,833,736, 4,993,085 and 5,142,709 disclose such toilet seat lifts. Transferring the user's weight forward is undesirable for persons with limited control of their leg muscles and may cause these person to become unbalanced. Further, these tilting toilet seats either do not provide arm rests or the arm rests tilt along with the seat lift. This is undesirable for the user's who need a substantially horizontal arm-support surface to support themselves as they are moving to a self-supported or assisted standing position.

These toilet seat lifts also do not accommodate users of varying height and girth. A short, thin elderly woman has different lift height requirements and arm rest requirements than an obese, tall male. The toilet seat lifts hereinbefore described do not adequately address these differing height requirements.

In view of the above-described problems, it is an object of the present invention to provide an apparatus for assisting a physically disabled person to and from a seated position immediately above a toilet bowl that requires a minimum floor space and can be easily moved from one toilet to another. It is a further object to provide an apparatus that is not permanently mounted to the floor for safe operation.

It is a further object to provide an apparatus that provides easily accessible control for the user, is easy to operate and accommodates individuals virtually any size.

SUMMARY OF THE INVENTION

These objects, as well as other objects and advantages are achieved by an apparatus for moving a toilet seat between a lowered position adjacent a toilet bowl and a raised, tilted position above the toilet bowl to assist a physically disabled person between an upright position and a seating position for using a toilet. The apparatus includes a toilet seat having a passageway therethrough, a support structure positioned about a base portion of a toilet bowl, a linkage mechanism attached to the support structure for raising the toilet seat directly above the toilet bowl and for tilting the toilet seat such that the rear portion of the toilet seat assumes a vertically higher position than a front portion of the toilet seat, and a power mechanism for urging the toilet seat between the lowered position and the raised, tilted position.

Other objects and advantages of the present invention will become apparent from the following description taken in conjunction with the accompanying drawings, which constitute a part of this specification and wherein are set forth exemplary embodiments of the present invention to illustrate various objects and features thereof.

BRIEF DESCRIPTION OF THE DRAWINGS

In the drawings, wherein like referenced characters are used throughout to describe like parts.

DESCRIPTION OF PREFERRED EMBODIMENTS

Figure 1:
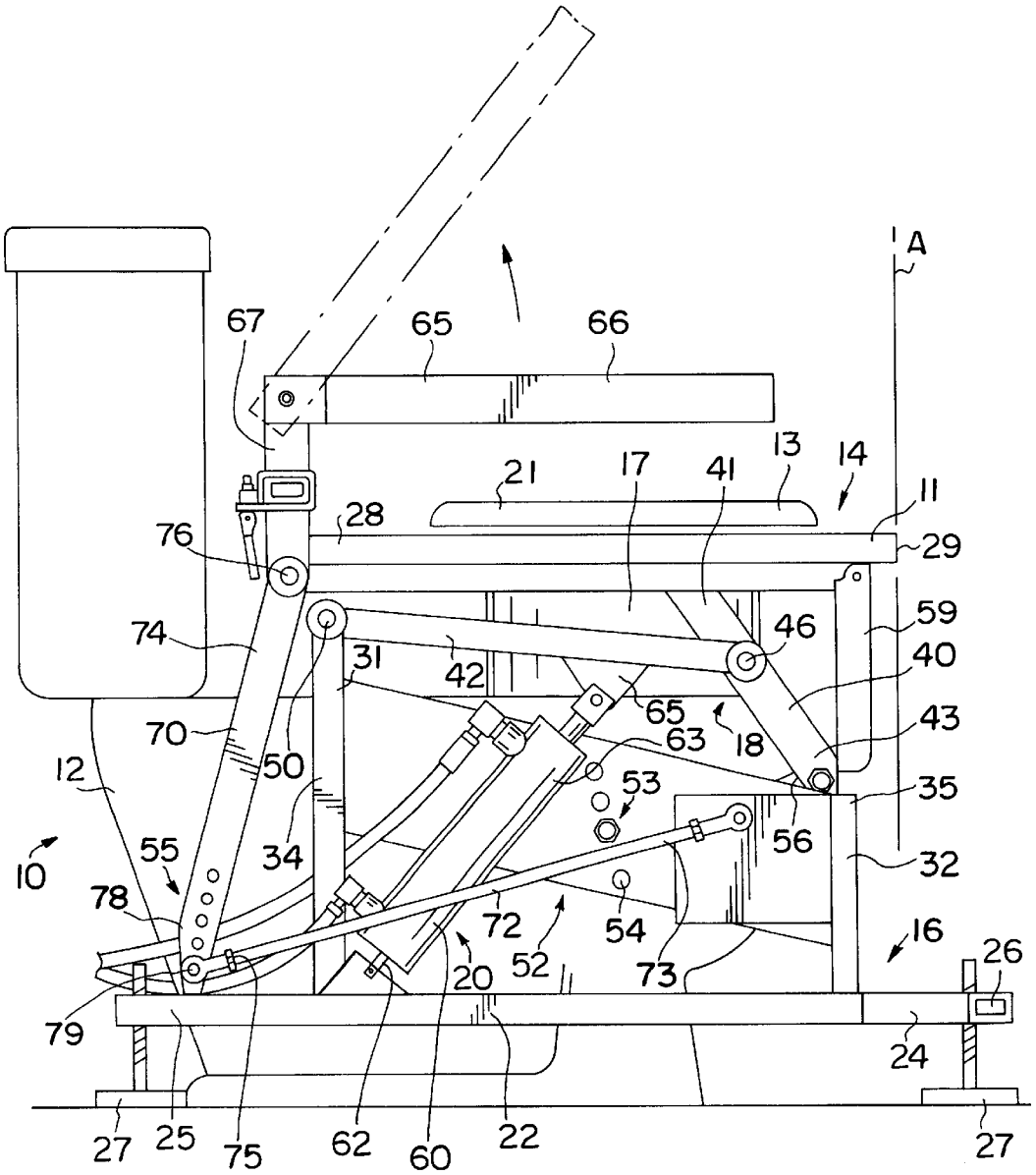
FIG. 1 is a side elevational view of the powered toilet seat lift in a lowered position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The apparatus of the present invention for assisting physically disabled or illness-weakened persons between a seated position and a raised tilted position immediately above a toilet 12 is indicated generally at 10. The apparatus 10 includes a seat structure generally indicated at 14, a support structure generally indicated at 16, linkage means generally indicated at 18 attached to the support structure for raising the toilet seat directly above the toilet bowl and for tilting the toilet seat, and power means generally indicated at 20 for urging the toilet seat between the lowered position and the raised, tilted position. The apparatus 10 raises the seat 14 between a lowered position above a toilet bowl and a raised, tilted mounting or dismounting position.

The seat structure 14 of the apparatus preferably comprises a seat base 11, and a conventional toilet seat 13, which defines a central opening 15. In the lowered position shown in FIG. 1, the seat 13 communicates with a toilet bowl and includes a skirt 17, which defines an enclosed interior passageway 19 slidably received in the toilet bowl or receptacle to provide a flow way into the toilet bowl. A cover (not shown) hingedly mounted to the seat 14 may be used when the assembly is not in use. The seat 14 has a hollow platform defining a central opening therethrough for communication with the toilet bowl in the lowered portion and an enclosed interior passageway. Further, the apparatus may be supplied with a hose connected to the water supply for the toilet and a spray nozzle (not shown) for cleaning the toilet seat's skirt 17 after use. A restraining device (not shown), such as a seat belt, may be mounted to seat base 11 to secure the user to the apparatus during operation.

The support structure 16 of the present invention is a free-standing unit in that it does not require the toilet seat for support. The support structure 16 includes a generally U-shaped base generally indicated at 22 configured to surround a standard toilet. The base 22 includes two parallel main supports 23 that as the apparatus is positioned about a toilet bowl are disposed on each side of the bowl. Each main support 23 has a forward and rearward end, 24, 25, respectively, as positioned about a toilet seat, and a cross support 26 preferably extending between the forward ends 24 of each main support.

Figure 3:
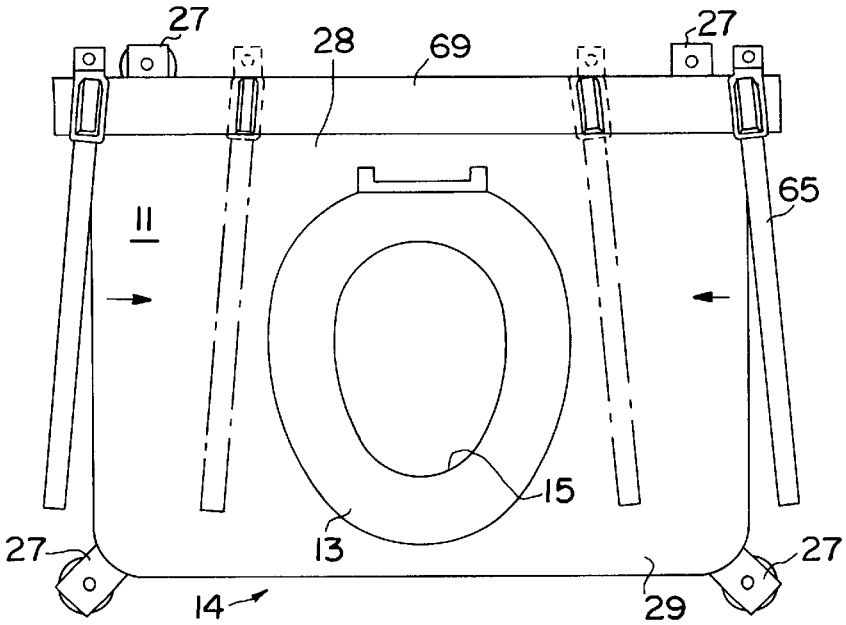
FIG. 3 is a top plan view of the powered toilet seat lift of the present invention.
Figure 6:
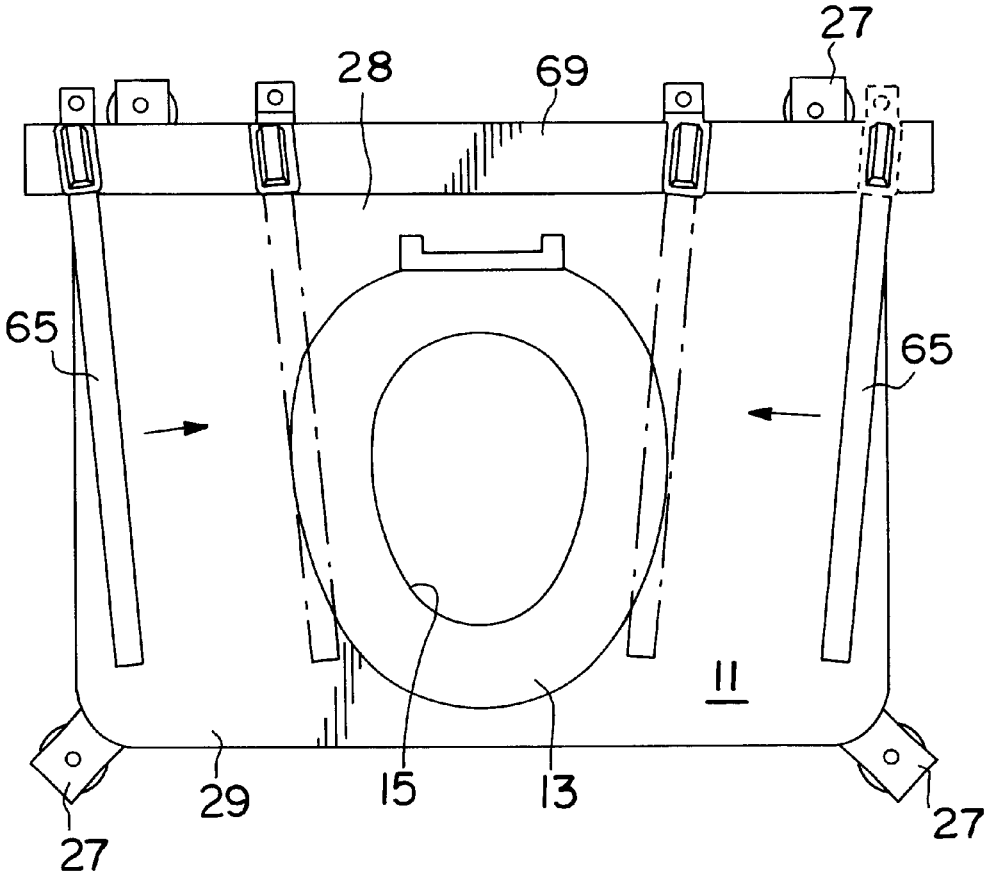

The base 22 includes four feet, each indicated at 27 mounted to the forward and rearward ends, 24, 25, respectively, of each main support. In order to provide stability for the seat lift of the present invention, the feet at the forward end 24 of the support structure 16 extend diagonally outwardly from the base as shown in FIGS. 3 and 6. Preferably, the feet extend outwardly at 135° angles from the cross support 26. The rear feet extend rearwardly outwardly from each main support 23. For further stability, the front feet are spaced apart by a distance greater than the rear feet. Preferably, the front feet are spaced approximately 28 inches apart and the rear feet are spaced approximately 22 inches.

Figure 2:
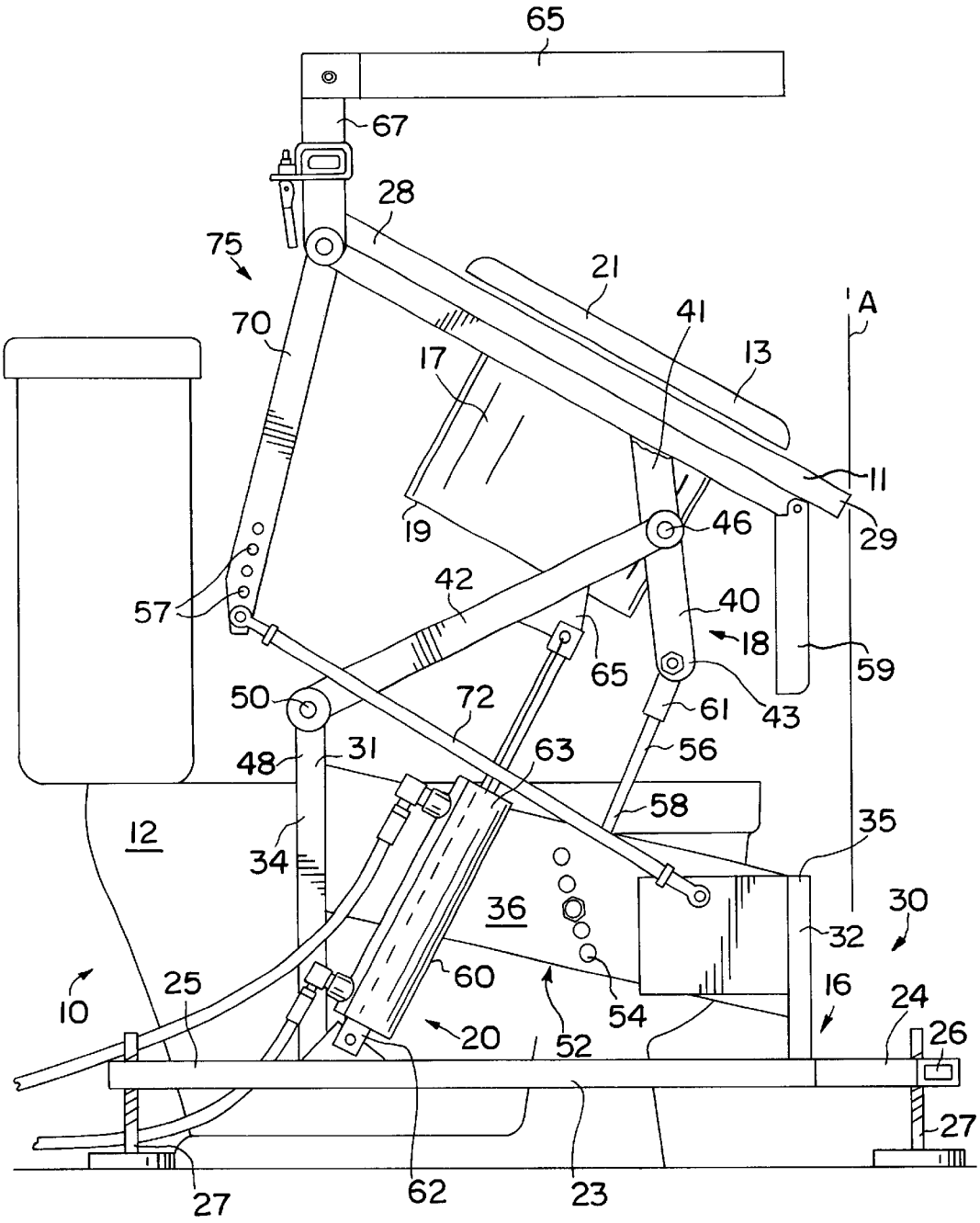
FIG. 2 is a side elevational view of the powered toilet seat lift in a raised position.

As shown in FIGS. 1 and 2, the feet 27 are preferably threadably mateable to the supports such that the apparatus may be properly leveled and adjusted for different sized toilets (e.g., standard and handicapped toilets). Further, these threadable feet provide height adjustment for the particular characteristics of the user. The feet 27 may be adjusted to move the seat structure 16 an additional 6 inches to 8 inches from the toilet bowl 12. The seat 14 remains in communication with the bowl 12 through skirt 17. It will be understood that the support structure may be permanently attached to the floor or may include other mechanisms to raise and lower the feet of the support structure without departing from the scope of the present invention. Specifically, the feet may include hydraulic lifts to level and adjust the support structure.

Non-skid pads (not shown) are mounted to the bottom of the feet 27 to provide a stationary support structure. Alternatively, casters may be provided at the bottom of the feet to provide for the easy transport of the seating apparatus. The casters are of the locking type to provide a stationary apparatus for use above a toilet seat or other receptacle.

Linkage means 18 sometimes referred to as linkage or linkage mechanism is attached to the main supports 23 of the support structure for raising the toilet seat directly above the waste container and for tilting the toilet seat such that rear portion 28 of the seat 14 assumes a vertically higher position than a front portion 29 of the toilet seat. The linkage means 18 includes laterally spaced upstanding side sections, generally indicated at 30, adapted to be disposed on either side of a standard toilet bowl. The side section 30 each include a fixed forward end 32, a fixed rearward end 34, and a cross member 36. The fixed rearward end 34 of each side section 30 extends further upwardly than the front section 32 of the side section as shown in FIG. 2.

As shown in FIG. 1, the seat 14 is pivotally connected at its forward portion 29 to an upper portion 31 of the rearward end 34 of each upstanding side section 30 through an interconnection member 40 and cross member 42. The upper end 41 of each interconnection member 40 is fixedly connected to the front portion of the seat. Cross member 42 is pivotally connected to the interconnection through pivot pin 46 at a position between the upper 41 and lower end 43 of interconnection member 40, as shown in FIG. 1. Crossing member 42 is further pivotally connected to the upper portion 31 of the upstanding side section's rearward end 34 through pivot pin 50. Pivot pins 50 are located between 15–22 inches above the floor, and preferably 18 inches above the floor, which is approximately the height of articulation of the knee joint for the average adult user. This height range for knee articulation is provided by the threaded feet 27, which allows support structure 16 to be adjusted and thus allows pivot pins 50 to adjust through the aforementioned range. The seat 14 of the apparatus is further pivotally connected at its rearward portion 28 to the forward end 32 of each upstanding side section 30 through an interconnection member 70 and a cross member 72. An upper end 74 of interconnection member 70 is pivotally connected to the seat through pivot pin 76 and a lower end 78 of interconnection member 70 is pivotally connected to a rearward end 75 of cross member 72 at pivot pin 79. The forward end 73 of cross member 72 is pivotally connected to the forward end 32 of the upstanding side section 30.

Power means 20 urges the seat 14 of the apparatus 10 between the lowered position and the raised, tilted position whereby the person is assisted up from and down to a seated position immediately above the toilet bowl. The power means of the present invention comprises a pair of hydraulic cylinder assemblies 60 disposed between the base 22 of the support structure 16 and the crossing member 42 on each side of the apparatus for raising and lowering the seat of the apparatus between the horizontal, seated position as shown in FIG. 1 and the raised, tilted position shown in FIG. 2. The bottom portion 62 of the hydraulic units are pivotally connected to the main supports 23 of the support structure and the upper portion 63 of the hydraulic units are pivotally connected to a downwardly extending flange 65 of the crossing member 42. The hydraulic units are operated by a hydraulic pump (not shown) driven by a reversible motor (not shown). A switch operates the motor and may be located near handrails provided on the apparatus or through a remote actuator, such as a foot pedal, which may be operated by an assistant. It is to be understood that the power means may comprise other means for urging the seat from the horizontal position to the raised, tilted position, without departing from the scope of the present invention.

The linkage mechanism of the present invention is configured to raise and tilt the toilet seat as the hydraulic cylinder 60 urges the seat upwardly while maintaining the front portion 29 of the toilet seat 14 along a vertical axis, indicated at A in FIGS. 1 and 2. The tilt of the toilet seat occurs gradually throughout the raising of the toilet seat. Hydraulic cylinders 60 raise each cross member 42 about pivot 50, which in turn raises member 40. Lower end 43 of member 40 is restrained by interconnecting member 56, which restrains interconnecting member 40 such that each member 40 pivots about pivot 46. This pivoting movement causes toilet seat 14, which is fixedly connected to the upper end 41 of member 40, to tilt such that the rearward portion of toilet seat 14 is at a vertical higher position than the forward end. Further, interconnecting member 56 restrains member 40 such that front portion 29 of the toilet seat substantially maintains vertical axis A.

Preferably, the seat lift of the present invention further includes a linkage cover 59, which is hingably mounted to seat base 11. As shown in FIG. 2, as the seat is raised and tilted, the hinge cover 59 protects the user from accidentally placing their hands by the linkage mechanism. Although not shown, it is contemplated that similar hinge covers could be used for each side of the toilet seat lift.

The apparatus of the present invention further includes a pair of arm supports 65 for supporting the person during travel between the lowered position and the raised, tilted position. As shown in FIG. 2, the arm supports of the apparatus preferably remain substantially horizontal during the raising and lowering of the toilet seat to provide the user a platform to steady themselves. The arm supports 65 are generally L-shaped: each arm support having a main support 66 and a leg 67 for mounting to the apparatus. The main support 66 of each arm is configured to be slightly bowed, as shown in FIG. 3. The bow of each arm is such that main supports 66 of each arm support either bows slightly outwardly away from a user or slightly inwardly to wrap around the user. The arm supports are removably mounted on rear mount 69 through bracket 81 such that the pain arm support are interchangeable to allow for either an inward or outward bow of the supports. Further, the arm supports 65 are selectively adjustable on rear mount 69. Bracket 81 of each arm support is releasably mounted to rear mount 69 through a releasable clamp 83. Thus the apparatus of the present invention further accommodates users of different sizes by providing arm rests that surround a relatively thin user, or that accept obese users by providing additional space.

Figure 4:
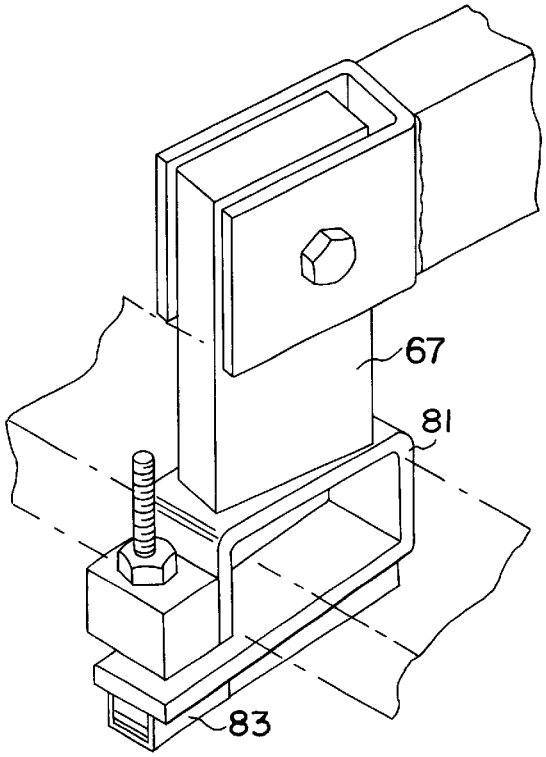
FIG. 4 is a partial perspective view of the arm support of the present invention.
Figure 5:
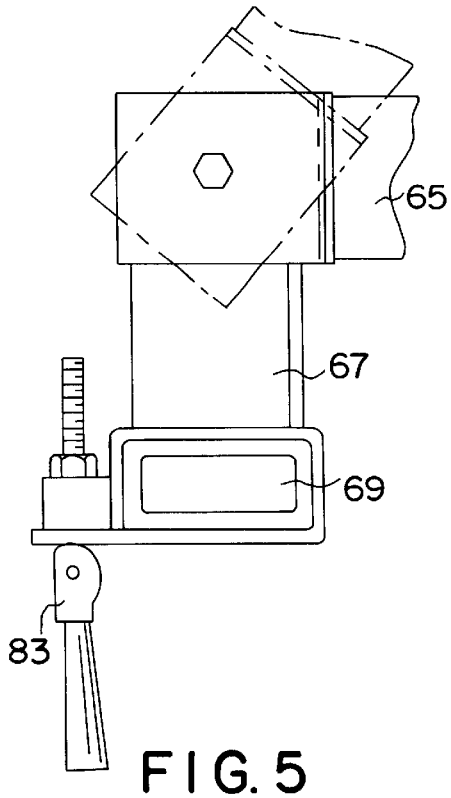
FIG. 5 is a partial side elevational view of the arm support bracket of the present invention; and, FIG. 6 is a top plan view of the powered toilet seat lift showing the arm supports bowed inwardly.

Further, to facilitate the entry or exit of the user, a selectively pivotal connection is provided between the main support and leg of the armrest as shown in FIGS. 4 and 5 to allow each armrest to pivot upwardly away from the seat 14. The arm supports 65 are locked in place at a substantially vertical position through a detent (not shown). Thus, either main support is swingable upwardly to facilitate entry or dismounting by the user.

It is contemplated that a relatively large number of persons of various heights will use the seat assembly 10. Thus, a height adjustment means, indicated generally at 52, for varying the vertical height of the raised position from the toilet bowl is provided. Height adjustment means 52 comprises a forward seat-adjustment 53 mechanism and an arm support-adjustment mechanism 55.

The forward seat adjustment mechanism comprises height-adjustment slots 54 formed in the cross member 36 of each upstanding side section 30 and an interconnecting member 56 releasably and pivotally secured at a lower end 58 in a height adjustment slot and pivotally secured at its upper end 61 to the lower end 43 of interconnecting member 40. The height of extension of each interconnecting member 40 away from the respective upstanding side section 30 is thus limited by the length of interconnecting member 56, as shown in FIG. 2. Interconnecting member 56 may be secured in any one of several vertically spaced slots 54 to vary the height away from the side section 30. As such, the height-adjustment means 52 provides a range of extension for the forward portion 29 of the seat 14 from the upstanding side sections 30 to accommodate users of different heights. It will be understood by those skilled in the art that the height adjustment means may be accomplished by other means, such as by hydraulic means, and still be within the scope of the present invention. For instance, the height adjustment means may include an arcuate slot that extends longitudinally vertically wherein interconnecting member 56 can be secured at a particular level therein.

The arm support-adjustment mechanism 55 of the height-adjustment means 52 comprises vertically spaced holes 57 along interconnecting member 70 for releasably receiving cross member 72. The connection between cross member 72 and interconnection member 70 is thus adjustable along the generally vertically inclined interconnecting member to adjust the height of the arm supports 65 away from the toilet seat 14. Through this adjustment, the tilt of the seat can remains constant.

In operation, the seat 14 is initially set up to surround the particular toilet bowl or other waste receptacle. The threaded feet 27 are adjusted such that the seat of the apparatus is substantially horizontal in the seated position and the skirt 17 of the seat provides a flowway into the toilet bowl or other receptacle. When an invalid or elderly person wishes to use the toilet seat lift 10 shown in FIGS. 1 and 2, the apparatus is positioned in the raised and tilted position through the control switch. The height of the lift is adjusted to accommodate the particular user through the forward seat adjustment mechanism 53 by securing interconnecting member 56 into an appropriate slot 54. The arm support adjustment mechanism 55 is adjusted by selecting the proper slot 57 for the connection between the crossing member and interconnecting member to adjust the height of the rearward portion 28 of the seat 14 relative to the forward portion 29 of the seat. The tilt of the seat in the raised position may be adjusted in this manner to fit a particular user.

The arms 65 of the apparatus are mounted to the apparatus fit the particular user. Either the arms slightly surround the user or extend away from the user depending on the users size to provide a platform to control their body weight. If required, one or both arms may be pivoted upward, as shown in FIG. 1, away from the user to facilitate entry onto the seat of the apparatus.

The user than backs onto the seat 14 of the apparatus, either with assistance or under their own control, until their upper thigh contacts the forward portion of the seat. The user can then lean back against the seat, and the controls for the apparatus may be operated to retract the hydraulic unit thereby lowering the seat and bringing it to the horizontal position. If the user is a totally incapacitated individual, the assistant may strap the user to the apparatus through a suitable seat belt (not shown) for preventing the user from sliding off the seat. Further, if the user is arthritic or in a cast, the apparatus may be halted at any desired position which will accommodate the user.

When the user desires to be raised from the seated position to a standing position, the user or attendant simply operates the switch of the reversible motor to again raise the seat and thus the user upwardly. The tilt of the seat assists the user to transfer the user's weight to their legs. To assist in this transfer of weight, the arm rests 65 remain parallel to provide the user a platform to support their weight.

The toilet seat construction described above does not interfere with the use of the toilet by non-invalid user, nor does it hinder cleaning of the toilet bowl.

While the invention has been shown and described with reference to the preferred embodiment, it will be understood by those skilled in the art that various changes in form may be made without departing from scope of the invention. For instance, it is recognized that equivalent power operable mechanisms, such as rack and pinion assemblies or rotatable screw shaft assemblies can be employed in place of the hydraulic assemblies described above.

What is claimed is:

1. An apparatus for moving a toilet seat between a lowered position adjacent a toilet bowl and a raised, tilted position above a waste container to assist a physically disabled person between an upright position and a seated position for using a toilet, the apparatus being independent of the waste container and comprising:

a toilet seat having a hollow platform defining a central opening therethrough for communication with said toilet bowl in said lowered position and having an enclosed interior passageway;

a support structure adapted to be positioned about the waste container;

linkage means attached to said support structure for raising the toilet seat directly above the waste container and for tilting the toilet seat such that a rear portion of the toilet seat assumes a vertically higher position than a front portion of the toilet seat;

power means for urging the toilet seat between the lowered position and the raised, tilted position; and support arms configured to remain substantially parallel during travel between the lowered position and the raised, tilted position whereby the person is assisted up from and down to a seated position immediately above the toilet bowl.

2. The apparatus of claim 1 wherein apparatus further includes height adjustment means for varying the vertical height of the raised, tilted position from the toilet bowl.

3. The apparatus of claim 1 wherein the arms of the apparatus are further pivotally mounted on the support structure to facilitate the seating of the person.

4. The apparatus of claim 1 wherein the arms of the apparatus are further adjustable on an horizontal plane to adjust to differently sized persons.

5. An apparatus for moving a toilet seat between a lowered position adjacent a toilet bowl and a raised, tilted position above the toilet bowl to assist a physically disabled person between an upright position and a seated position for using a toilet, the apparatus comprising:

a toilet seat having a hollow platform defining a central opening therethrough for communication with said toilet bowl in said lowered position and having an enclosed interior passageway;

a support structure adapted to be positioned about a base portion of the toilet bowl;

linkage means attached to said support structure for raising the toilet seat directly above the toilet bowl and for tilting the toilet seat such that a rear portion of the toilet seat assumes a vertically higher position than a front portion of the toilet seat;

power means for urging the toilet seat between the lowered position and the raised, tilted position; and support arms configured to remain substantially parallel during travel between the lowered position and the raised, tilted position whereby the person is assisted up from and down to a seated position immediately above the toilet bowl.

6. The apparatus of claim 5 wherein apparatus further includes height adjustment means for varying the vertical height of the raised, tilted position from the toilet bowl.

7. The apparatus of claim 6 wherein the height-adjustment means for varying the vertical height of the raised, tilted position from the toilet bowl includes forward seat adjustment mechanism and rearward seat adjustment mechanism.

8. The apparatus of claim 6 wherein the height-adjustment means for varying the vertical height of the raised, tilted position includes vertically adjustable feet mounted to the support structure for adjusting the height of the apparatus.

9. An apparatus for moving a toilet seat between a lowered position adjacent a toilet bowl and a raised, tilted position above the toilet bowl to assist a physically disabled person between un upright position and a seated position for using a toilet, the apparatus comprising:

a toilet seat having a hollow platform defining a central opening therethrough for communication with said toilet bowl in said lowered position and having an enclosed interior passageway;

a support structure adapted to be positioned about a base portion of the toilet bowl;

a linkage attached to said support structure for raising the toilet seat directly vertically above the toilet bowl and for tilting the toilet seat such that a rear portion of the toilet seat assumes a vertically higher position than a front portion of the toilet seat while remaining above the toilet bowl;

power means for urging the toilet seat between the lowered position and the raised, tilted position through the linkage whereby the person is assisted up from and down to a seated position immediately above the toilet bowl; and height-adjustment means for varying the vertical height of the raised position from the toilet bowl.

10. The apparatus of claim 9 wherein the apparatus further includes arms for supporting the person during travel between the lowered position and the raised, tilted position.

11. The apparatus of claim 10 wherein the arms for supporting the person are substantially horizontal and remain substantially horizontal during travel between the lowered position and the raised, tilted position.

12. The apparatus of claim 10 wherein the arms are pivotally mounted on the support structure to facilitate the seating of the person.

13. A method of assisting a physically disabled person to move between an upright position and a seated position for using a toilet comprising the steps of:

lifting a toilet seat directly vertically upwardly and tilting it so that when it is in its elevated position the seat is tilted and a forward edge of the seat is lower than a rearward edge of the seat and the seat is directly above a toilet bowl whereby the person may rest against the toilet seat while remaining in a standing position;

permitting the seat to move vertically downwardly while supporting the person and gradually during downward movement changing the angle of the seat from its position with the rearward edge higher than the forward edge until it is substantially horizontal and the person is seated on it, whereby the person need not move his feet a substantial distance backwardly while going from a standing position to a seated position; and the step of lifting a toilet seat including the step of applying force to the toilet seat through a linkage that both lifts the toilet seat and tilts the toilet seat.

14. The method of claim 13 further comprising the steps of lifting the seat vertically upwardly while the person is seated on it, maintaining its periphery at its elevated position aligned with its periphery at its lower position but tilting it so that the rearward edge is raised to a higher level than the forward edge, whereby the person is not thrown off balance when being lifted from a seated position to a standing position.

15. The method of claim 13 further comprising the step of adjusting the starting and ending position of the toilet seat during moving vertically upwardly and downwardly by lifting the linkage and seat by an adjustable means.

16. The method of claim 13 further including the step of moving the seat and the linkage for raising and lowering the seat into position above an existing toilet.

17. The method of claim 14 further including the step of removing the seat and its linkage from the toilet to a storage position when not in use.

18. The method of claim 16 in which the step of moving the seat and linkage includes the step of moving the seat and linkage with a power source for lifting and lowering the seat.

19. A method in accordance with claim 13 in which the seat is tilted during its upward movement by a lever mechanism whereas horizontal arms on the seat for supporting arms of the disabled person are not tilted wherein they remain in a horizontal position as the seat is raised and lowered.

* * * * *